United States Patent [19]

Laurent et al.

[11] Patent Number: 4,964,147

[45] Date of Patent: Oct. 16, 1990

[54] ROTATING ANODE X-RAY TUBE COMPRISING ANODIC CURRENT FLOW DEVICE

[75] Inventors: Michel Laurent, Plaisir; Pierre Noualhagnet, Issy les Moulineaux; Claude Mathieu, Versailles, all of France

[73] Assignee: General Electric CGR SA, Paris, France

[21] Appl. No.: 297,686

[22] Filed: Jan. 17, 1989

[30] Foreign Application Priority Data

Jan. 18, 1988 [FR] France ..... 88 00503

[51] Int. Cl.[5] ..... H01J 35/10

[52] U.S. Cl. ..... 378/125; 378/144; 378/121

[58] Field of Search ..... 378/125, 143, 144, 132, 378/121

[56] References Cited

U.S. PATENT DOCUMENTS

| | | | |
|---|---|---|---|
| 4,322,624 | 3/1982 | Cornelissen et al. | 378/125 |
| 4,504,965 | 3/1985 | Ebersberger | 378/125 |

FOREIGN PATENT DOCUMENTS

| | | | |
|---|---|---|---|
| 0151878 | 8/1985 | European Pat. Off. | 378/125 |
| 2716079 | 8/1978 | Fed. Rep. of Germany . | |
| 3004531 | 8/1981 | Fed. Rep. of Germany | 378/125 |
| 2532782 | 3/1984 | France . | |
| 2569051 | 2/1986 | France . | |
| 0060949 | 4/1984 | Japan | 378/125 |
| 0060950 | 4/1984 | Japan | 378/125 |
| 315978 | 10/1956 | Switzerland . | |

*Primary Examiner*—Janice A. Howell
*Assistant Examiner*—John C. Freeman
*Attorney, Agent, or Firm*—Oblon, Spivak, McClelland, Maier & Neustadt

[57] ABSTRACT

The invention relates to an X-ray tube with a rotating anode which is driven by a magnetic bearings motor. The anodic current is outflowed by a friction-type contact device which is located inside the shaft supporting the rotor of the motor. The friction contact device is actuated so as to cut off or establish an electrical contact between an inner wall of the rotor and the friction contact device.

4 Claims, 2 Drawing Sheets

ROTATING ANODE X-RAY TUBE COMPRISING ANODIC CURRENT FLOW DEVICE

BACKGROUND OF THE INVENTION

The present invention relates to a rotating anode and more particularly to means for flowing out the anode current of the tube, in particular when the tube is of the magnetic bearing type.

The X-ray tubes for medical diagnosis, for example, are generally constituted as a diode, ie. with a cathode and an anode or an anti-cathode, electrodes being enclosed within a vacuum sealed casing which ensures electrical insulation between these two electrodes. The cathode produces an electron beam and the anode receives such electrons on a small surface forming a focal point, the X- rays are emitted therefrom.

When the power supply high voltage is applied across the terminals of the cathode and the anode, so that the cathode be at a negative potential, a so-called anodic current is established in the circuit, through a generator that generates the power supply high voltage; the anodic current passes through the space between the cathode and the anode in the form of an electron beam which impinges onto the focal point.

A small proportion of the energy used for generating the electron beam is converted into X-rays, the remainder of the energy being dissipated into heat. Thus, also taking account of the high levels of instantaneous power involved (in order of 100 KW) and the small size of the focal point (in the order of 1 mm), manufacturers have for a long time produced rotating anode X-ray tubes wherein the anode is put into rotation for the thermal flow to be distributed over a crown or ring referred to as the focal crown or ring the area thereof being far larger than the focal point; the advantage becomes all the greater as the speed of rotation rises (in general between 3,000 and 12,000 revolutions per minute).

The conventional rotating anode is in the general form of a disc having an axis of symmetry about which it is put into rotation by means of an electric motor; the electric motor has a stator located outside the casing and a rotor mounted within the casing of the X-ray tube arranged along the axis of symmetry with the rotor made mechanically integral with the anode through a supporting shaft.

According to another well known construction still of very common use, the rotor is mounted on mechanical bearings provided with ball bearings. It is known that X-ray tubes of the mechanical bearing type have a shortened life span due notably to the wear of the ball bearings; one of the causes of wear is lubrication, which cannot be accomplished perfectly notably because of the vacuum existing within the X-ray tubes. However, one of the advantages of the mechanical bearings provided with metal ball bearings lies that there is conductive material contact between the rotating parts (rotor, anode) and the fixed parts of the tube (rotor support shaft, casing); this material contact is achieved by the bearing balls and at the same time constitues electrical contact so that the anodic current of the X-ray tube can flow out.

To overcome the problems raised by from the fast wear of mechanical bearings, a major improvement consists in assembling the rotating, more specifically the rotor, with magnetic bearings. Generally, these include electromagnets mounted in pairs opposited by which generate magnetic fields under the influence of which the rotor, integral with the rotating anode which rotated thereby, is maintained in a state of balance; the rotating anode and the mechanical parts in rotation therefore have no further material contact with the remainder of the X-ray tube.

The advantages of magnetic bearings when applied to the rotation of anodes are mainly the absence of noise, the absence of vibration and the possibility of obtaining a significantly increased lifetime of the rotating system.

But with magnetic bearings, the rotating anode is mechanically and electrically isolated from the fixed parts of the X-ray tube means so that implementation of means specifically intended for outflow of the tube anodic current is required.

For this purpose, it is known to use the emission of electrons produced by one or several auxiliary thermoemissive cathodes, linked mechanically with the rotating anode; these electrons are captured by one or several auxiliary anodes in fixed positions. One of the main difficulties is then to supply these auxiliary cathodes, put into rotation, with the energy needed to raise their temperature up to a sufficiently high level so as to satisfy the laws of thermo-electronic emission. In addition, solutions of this type are comparatively complex and expensive.

It is also known to use friction systems whereby electrical contact between the rotating parts and fixed parts of the X-ray tube is obtained by the friction of two parts against one another, one coupled in rotation with the rotating anode and electrically connected to the latter, and the other being a part in a fixed position electrically connected to the positive polarity of the X-ray tube power supply high voltage. But the latter solution, although it represents a rugged solution easy to build, is nevertheless a mechanical friction solution which implies its wear to grow much faster than the wear of magnetic bearings thus also tending to shorten the possible lifetime of the X-ray tube.

SUMMARY OF THE INVENTION

The present invention relates to a rotating anode X-ray tube of the type wherein the anodic current of the tube is made to flow out by means of a friction contact device, and the arrangement thereof is such as to limit the operating time of the contact device thereof so as to slow down its wear. The present invention applies particularly, but not exclusively, to rotating anode X-ray tubes of the magnetic bearings type but its application may also be worthwhile in the case of mechanical bearings, when the bearing balls are electrically insulating.

According to the invention, an X-ray tube comprising a rotating anode, a rotor integral with the anode, a cathode, a friction contact device, the rotor being electrically connected to the anode and the tube being powered by a high voltage the negative polarity of which is applied to the cathode and the positive polarity of which is applied to the anode through the friction contact device, which friction contact device includes a first part and a second part, said first part being located inside the rotor and connected to the positive polarity and to the anode and said second part being coupled in rotation with the anode, both first and second parts being in friction contact with one another so as to establish between them an electrical contact for handling the outflow of the tube anodic current, further comprising means for separating or combining said first and second parts so as to cut off or to establish electrical contact between said first and second parts.

DESCRIPTION OF THE PREFERRED EMBODIMENT

Better understanding of the invention will be gained from the following description, given as a non-limitative example, and the three appended figures among which:

Figure 1:
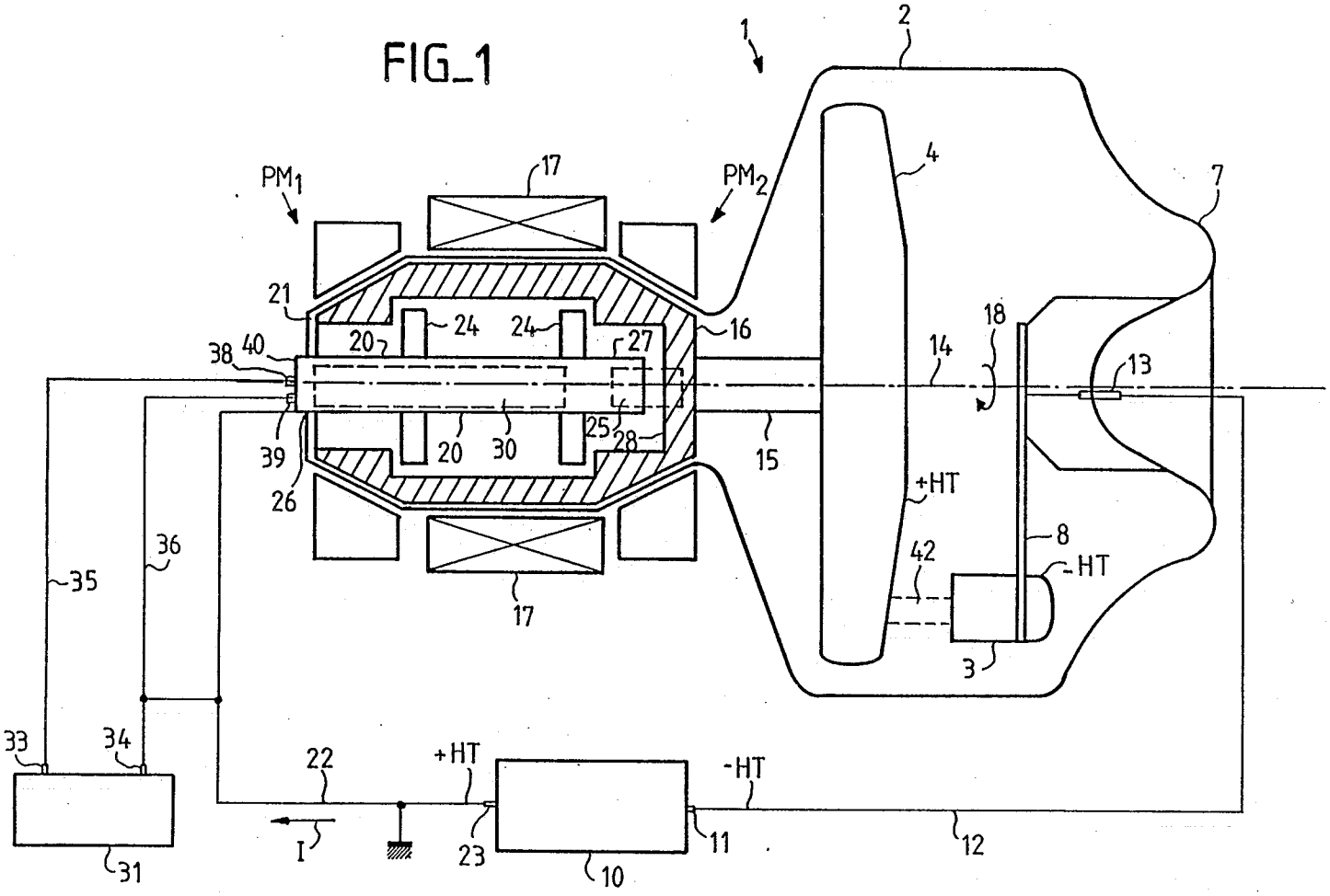
FIG. 1 shows in a schematic view manner an X-ray tube in accordance with the invention.

FIG. 1 shows in a schematic manner an X-ray tube according to the invention. The tube 1 includes a vacuum sealed casing 2 wherein a cathode 3, a rotating anode 4, and a rotor 16 are contained. Cathode 3 is facing the anode 4 and is supported by a cathode support 8 attached to one end 7 of casing 2.

On operation, the anode 4 is at the positive +HT polarity of a high voltage, generated by a high voltage generator 10 and the cathode 3 is at the negative −HT polarity of this high voltage the negative polarity −HT is supplied by an output terminal 11 of a generator 10, which is connected to the cathode 3 by a conductor 12 between the terminal 11 and cathode 3 via an insulating and sealed feed-through 13.

The rotating anode 4 has the general overall shape of a disk having an axis of symmetry 14. The anode 4 is attached to a supporting shaft 15 whereby it is made integral with rotor 16, the rotor 16 and supporting shaft 15 being arranged according to the axis of symmetry 14. The rotation of rotor 16 is started by the action of a stator 17 located outside the casing 2 and the rotation of rotor 16 is driving the anode 4 in rotation about the axis of symmetry 14 as indicated by an arrow 18 for instance.

In the non-limitative example described herein, the suspension of the rotor 16 during its rotation is provided by magnetic bearings of a type including a first and second conical bearing PM1, PM2

In the non-limitative example described herein, the rotor 15 is hollow and rotates about a fixed supporting shaft 20, the axis thereof being the axis of symmetry 14. The supporting shaft 20 is attached to a second end 21 of the casing 2 in such a way as to include a first end 26 which protrudes beyond the casing 2; this end 26 of supporting shaft 20 being connected, by a second conductor 22, to a second terminal 23 of the high voltage generator 10 whereby the positive polarity +HT of the high voltage is provided.

The fixed supporting shaft 20, the rotor 16 and the supporting shaft 15 are metallic and can therefore be used to conduct the positive +HT polarity to anode 4. But because of the magnetic suspension of the rotor 16, when the latter is rotating, no mechanical contact is established between the rotor 16 and the fixed shaft 20; bearings 24 mounted on the fixed shaft 20, within the rotor 16, form guard bearings which are in contact with the rotor 16 only when it is no longer maintained in a state of balance by magnetic bearings PM1, PM2.

Therefore, the electrical link between the fixed shaft 20 and rotor 16 is made by means of a friction contact device 25 (indicated by a dotted rectangle).

In the non-limitative example of the description, the friction contact device 25 is mounted within rotor 16, in a second end 27 of the fixed supporting shaft 20, in such a way as to establish electrical contact between the fixed supporting shaft 20 and inner wall 28 of the rotor, such wall being located in a plane substantially perpendicular to the axis of symmetry 14 and the fixed support 20.

According to a feature of the invention, the X-ray tube 1 further includes means 30 (indicated by a dotted rectangle) for establishing or suppressing as desired the electrical contact provided by the contact device 25 between the fixed support 20 and the rotor 16, i.e. means enabling the contact device 25 to be transformed into a switching circuit which can be opened or closed as desired under control of means 30. Indeed, these means 30 constitue a control device 30 used for operating the contact device 25 and which draws its energy from an electrical power supply source 31.

Figure 2:
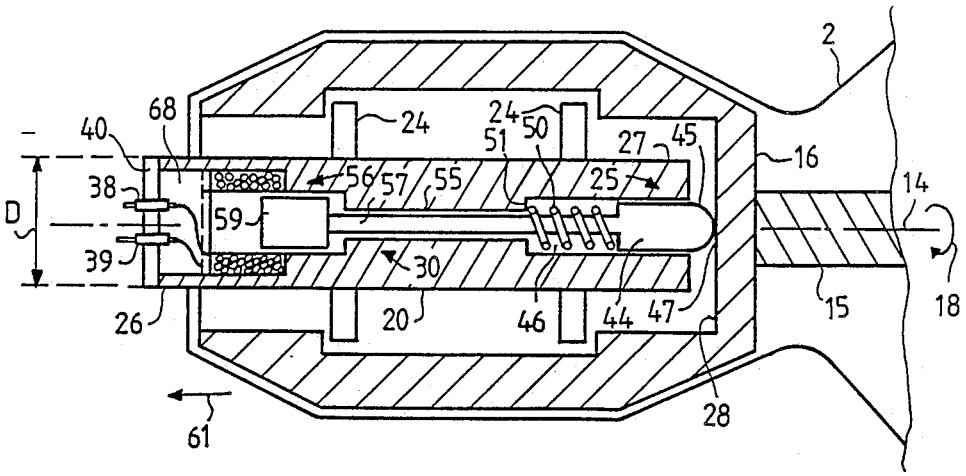
FIG. 2 is a sectional schematic view of a rotor as shown in FIG. 1 and containing means of the invention according to a first embodiment of said invention.

In the non-limitative example described herein, the control device 30 is mounted in the tube 1 where it is arranged within the fixed supporting shaft 20 which, for this purpose is hollow as is explained further in relation to the description of FIG. 2. A low voltage is supplied by two terminals 33, 34 of the voltage source 31; this low voltage is applied by a third and a fourth conductor 35, 36 to the control device 30 through a second and third insulating and tight feed-through 38, 39, arranged in an end wall 40 placed at the first end 26 of the fixed supporting shaft 20.

In this configuration, the operation of the X-ray tube 1 consists first in establishing the rotation of rotating anode 4 by energizing the stator 17 and also the magnetic bearings PM1, PM2 in a known way (not shown), then in establishing electrical contact between rotor 16 and fixed support shaft 20 by operating the contact device 25 and, finally, in applying between the anode 4 and cathode 3 the high voltage supplied by the high voltage generator 10 : the anodic current I is then established in the circuit and passes through the space between the cathode 3 and anode 4 as an electron beam 42. The high voltage is cut-off at the end of the X-ray examination, and then the control device 30 operates the contact device 25 to cut off the electrical contact thus interrupting the wear of the parts (not shown in FIG. 1) serving to establish such electrical contact. The rotation of the anode 4 can then be interrupted; but, of course, the rotation of anode 4 can be maintained without damage because the wear of contact device 25 is interrupted.

FIG. 2 shows the rotor 16 in a view similar to that of FIG. 1 but enlarged in order to show the different elements of the contact device 25 as well as the elements of control device 30 in a first embodiment of the invention.

The contact device 25 includes a metallic friction device 44, of which one end 45 bears against the inner wall 28 of the rotor 16. Friction device 44 is mounted in a housing 46 formed in the supporting shaft 20 at the second end 27 of said axis. Housing 46 and friction device 44 are arranged according to the axis of symmetry 14 in such a way that a contact zone 47 between the friction device 44 and the inner wall 28 is centered on the axis of symmetry 14; the end 45 of friction device 44 is spherical in shape and, further, the axis of symmetry 14 forming the axis of rotation of rotor 16 results in t he linear speed being almost null in the contact zone 47, which tends to eliminate wear. Friction device 44 is urged against the inner wall 26 of the rotor 16 under the thrust of a spring 50 which is compressed between a base 51 of the housing 46 and friction device 44. This provides electrical contact between the rotor 16 and the friction device 44 which itself is in contact with the supporting shaft 20 per se and by means of the spring 50; the fixed supporting shaft 20 is connected to the +HT positive polarity as shown in FIG. 1.

To cut off the electrical contact between rotor 16 and the fixed support shaft 20, pulling the friction device 44 toward base 51 of housing 46, is sufficient which is performed by means of control device 30. For this purpose, in the non-limitative example of this first embodiment of the invention, the control device 30 includes an electromechanical device or an electromagnet 56, known per se, mechanically connected to the friction device 44 by a rod 57. In the non-limitative example described herein, the electromagnet 56 is arranged in a cavity 68 formed in the fixed support shaft 20 on the side of the first end 26 of the latter; the cavity 68 communicates with housing 46 through a channel 55 arranged according to the axis of symmetry 14 and wherein the rod 57 can slide. The electromagnet 56 includes a coil 58 and a mobile element or core 59 integral with the rod 57. The coil 58 is connected electrically to the voltage source 31 (shown in FIG. 1), through insulating and sealed feed-through 38, 39 mounted in the end wall 40; the end wall 40 is mounted onto the end 26 in a sealed manner by welding for example.

Under these conditions, the energizing of the coil 58 causes core 59 to move toward the first end 26 in the direction of the second arrow 61 and causes the friction device 44 to move in the same direction which further compresses spring 50, and to move away from inner wall 28. Friction device 44 is no longer in contact with the inner wall 28 as long as the coil 58 is powered and its contact is reestablished when the power supply of coil 58 is cut off; this tends to achieve operational safety whereby providing electrical contact even in the event of a coil 58 power failure.

In the non-limitative example described, the fixed supporting shaft 20 has a same diameter D over its entire length but the fixed supporting shaft 20 can have a larger diameter on the side of the first end 26 and thus, for example, have a conical or truncated shape (not shown) so as to have greater space, if necessary, for the cavity 68, i.e. for the control device 30.

Figure 3:
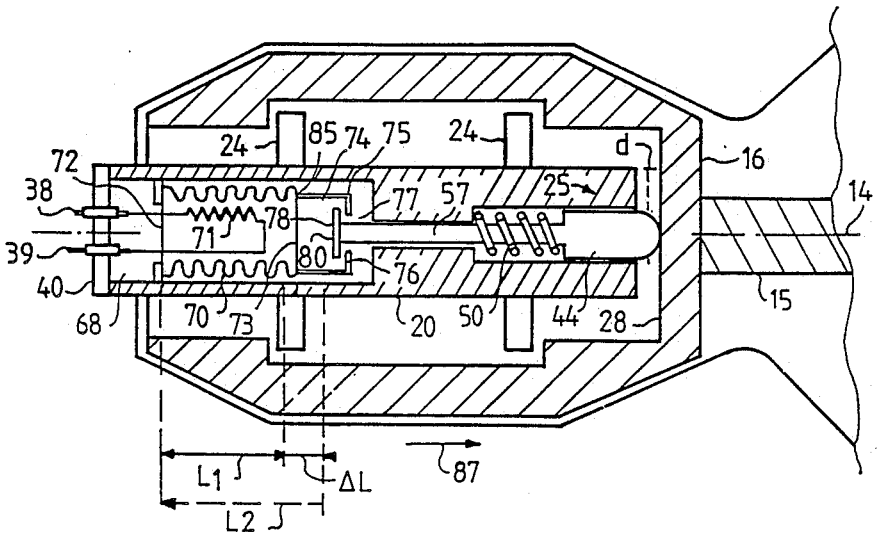
FIG. 3 shows schematically the rotor and some means of the invention in a second embodiment of said invention.

The FIG. 3 shows the rotor 16 and the contact device 25 similarly as in FIG. 2 and shows the control device 30 in a second embodiment which uses a sealed deformable chamber 70 capable of elongation along the axis of symmetry or the axis of rotation 14.

The enclosure 70 contains a fluid (not shown), a gas or a liquid, e.g. oil. In addition, it contains an electric heater element 71 connected to the voltage source 31 (shown in FIG. 1) through insulating and sealed feed-through 38, 39. The energizing of the heater element 71 causes the fluid contained in the chamber 70 to expand and the latter then changes from an inoperative position corresponding to a first length L1 to a deformed position corresponding to a second length L2 greater than the first one. When heater element 71 is no longer energized, the fluid cools and the chamber 70 comes back to its inoperative position and to its initial length L1. In the non-limitative example of the description, the inoperative position of chamber 70 where the latter has the initial length L1, corresponds to cutting off the electrical contact between rotor 16 and friction device 44 and the deformed state of chamber 70 wherein the latter has a greater length L2, tends to release the friction device 44 with the combined effect of the spring 50 so that the friction device 44 is urged against internal wall 28.

For this purpose, chamber 70 is set in the cavity 68 so that its length L1, L2 is parallel to the axis of symmetry or the axis of rotation 14; chamber 70 is secured by a first end face 72 oriented toward the end wall 40 while the second face 73 of chamber 70 is free in such a way as to permit the elongation of the latter. A tube 74 is secured by one end 85 to a second end face 73 of chamber 70. Tube 74 is arranged according to the axis of symmetry 14 and the second end 75 is closed by a plate 76. Plate 76 is centrally drilled with a hole 77 wherein rod 57 is engaged. The end 78 of rod 57, located within the tube 74 and which is opposite the friction device 44, is provided with a collar 80 or a locking piece which prevents this end 78 of the rod 57 from protruding from tube 74 through hole 77.

As electrical heater element 71 is not energized, chamber 70 assumes its shorter length L1 in such a way that it pulls upon friction device 44 through rod 57 the locking piece 80 of which is retained by plate 76 of tube 74; friction device 44 is then spread away from inner wall 28 by a distance "d", which distance "d" is, typically in the order of 3/10 of a millimeter.

When heater element 71 is energized, chamber 70 deforms and its length L1 increases to change gradually to longer second length L2 and which depends upon the level of fluid expansion as contained in chamber 70. At the beginning of the chamber 70 elongation, the movement of plate 76 in the direction of the third arrow 87 gradually releases the rod 57 and spring 50 pushes friction device 44 to bring it into contact with inner wall 28 of rotor 16, whereafter, friction device 44 and rod 57 are stationary whilst the tube 74 and second end face 73 continue to move through the deformation of chamber 70 until the latter reaches the second length L2. It should be noted that a difference in length L between the first length L1 and the second length L2 is much greater than the spacing "d" between the inner wall 28 and the friction device 44, so that the force with which friction device 44 bears against inner wall 28 of rotor 16 is only provided by spring 50.

Chamber 70 can be deformed according to its length L1, L2 by a heater element 71 as described above but in the spirit of the invention, the heater element 71 could be replaced by a device (not shown) to inject fluid into chamber 70 until the latter elongates.

It should be noted that deformable chamber 70 makes it possible to actuate contact device 25 with extreme progressivity, which is particularly advantageous if the rotor suspension is provided by a magnetic bearing system. Indeed, the stiffness of the centering system in the magnetic bearings is far less than for ball bearing systems in such a way that the position of the axis of rotation may depend upon the orientation of the rotor, which orientation could be modified, at least momentarily if the contact between friction device 44 and inner wall 28 of the rotor takes place too abruptly; this could result in a disturbance of the rotation movement of the anode, leading, more particularly, to modifications of the position of the focal point.

In the non-limitative example described herein, control device 30 includes a tube 74 the rod 57 of which is attached in such a way that the bearing force of friction device 44 on inner wall 28 is independent of the deformation of deformable chamber 70. But, of course the rod 57 could be made directly integral with the second end face 73 of chamber 70 and, possibly, the chamber 70 elongation could be determined to adjust the force by which friction device 44 bears against internal wall 28 as a function of the speed of revolution for example.

In the non-limitative example of the description, friction device 44 is in contact with the inner wall 28 only when chamber 70 is deformed i.e. when resistor 71 is energized. But, in the spirit of the invention, it is also possible to obtain the opposite effect, for example, by fixing the second end face 73 of chamber 70 and allowing the first end face 72 to be free while mechanically connecting end 78 of rod 57 to the first end face 72; this could be obtained in several ways (not shown), for example, by separating the end 78 of rod 57 into two arms passing either side and along chamber 70 to reach the first end face 72 or alternatively, by forming a deformable chamber 70 having on its length L2 a central hole (not shown) wherein rod 57 can be engaged to join the first end face 72.

What is claimed is:

1. An X-ray tube comprising:

an anode rotating about a defined axis and permanently fixed in position in the axial direction;

a rotor integral with said anode;

a cathode;

wherein said rotor is electrically connected to said anode and wherein said tube is powered by a high voltage having a negative polarity applied to said cathode and a positive polarity applied to a anode in a switchable manner via said friction contact device, said friction contact device being positioned inside said rotor and connected to said high voltage positive polarity, said contact device establishing switchable coupling with said rotor and said rotating anode in order to provide switchable electric contact for outflowing of tube anodic current, said tube further comprising a switching means for switching said contact between said rotor and said friction contact device in order to establish or cut-off said electrical contact for said outflowing of tube anodic current independent of the rotation of said anode.

2. An X-ray tube according to claim 1, further including a fixed supporting shaft positioned within said rotor with said fixed supporting shaft arranged according to said axis about which said rotor rotates.

3. An X-ray tube according to claim 1, wherein said switchable means comprises an electro-mechanical device for controlling the movement of said friction contact device wherein said electrical mechanical device is mechanically linked with said friction contact device in order to move said friction contact device along said axis of symmetry in order to establish said contact when said friction contact device is moved in a direction toward said anode.

4. An X-ray tube according to claim 1, wherein said switchable meaning comprises deformable chamber for controlling said friction contact device wherein said deformable chamber is mechanically linked with said friction contact device in order to move said friction contact device along said axis.

* * * * *

UNITED STATES PATENT AND TRADEMARK OFFICE

CERTIFICATE OF CORRECTION

PATENT NO. : 4,964,147

DATED : OCTOBER 16, 1990

INVENTOR(S) : MICHEL LAURENT ET AL.

It is certified that error appears in the above-identified patent and that said Letters Patent is hereby corrected as shown below:

ON THE TITLE PAGE: Item [75]

The second inventor's name is incorrectly spelled. Please delete "Noualhagnet" and insert --Noualhaguet--.

Signed and Sealed this

Twenty-ninth Day of September, 1992

*Attest:*

DOUGLAS B. COMER

*Attesting Officer*

*Acting Commissioner of Patents and Trademarks*